US008523970B2

(12) United States Patent
Lakdawala et al.

(10) Patent No.: US 8,523,970 B2
(45) Date of Patent: Sep. 3, 2013

(54) PORTABLE AIR FILTER

(76) Inventors: Ness Lakdawala, St. Lambert (CA); Quinn Rico, Saint Laurent (CA)

( * ) Notice: Subject to any disclaimer, the term of this patent is extended or adjusted under 35 U.S.C. 154(b) by 326 days.

(21) Appl. No.: 12/924,559

(22) Filed: Sep. 28, 2010

(65) Prior Publication Data

US 2011/0072770 A1 Mar. 31, 2011

Related U.S. Application Data

(60) Provisional application No. 61/272,475, filed on Sep. 28, 2009.

(51) Int. Cl.
*B01D 46/00* (2006.01)

(52) U.S. Cl.
USPC ..... 55/467; 55/356; 55/471; 55/472; 55/482

(58) Field of Classification Search
USPC ..... 55/356, 358, 361, 366, 373, 374, 55/378, 428, 429, 467; 96/224; 454/249, 454/251; D32/21
See application file for complete search history.

(56) References Cited

U.S. PATENT DOCUMENTS 1,559,804 A 11/1925 Sweeny
3,850,598 A * 11/1974 Boehm ..... 96/60
4,339,250 A 7/1982 Thut
4,477,270 A 10/1984 Tauch
4,629,482 A * 12/1986 Davis ..... 55/385.2
4,905,340 A * 3/1990 Gutschmit ..... 15/316.1
5,003,661 A * 4/1991 Wilson ..... 15/301
5,125,939 A 6/1992 Karlsson
5,290,330 A 3/1994 Tepper
5,312,465 A 5/1994 Riutta
5,399,319 A * 3/1995 Schoenberger et al. ..... 96/224
5,641,343 A * 6/1997 Frey ..... 96/135
5,837,020 A * 11/1998 Cartellone ..... 55/459.3
5,997,619 A * 12/1999 Knuth et al. ..... 96/224
6,053,968 A * 4/2000 Miller ..... 96/224
6,616,722 B1 * 9/2003 Cartellone ..... 55/459.3
6,783,578 B2 * 8/2004 Tillman, Jr. ..... 96/224
6,834,412 B2 * 12/2004 Stanovich et al. ..... 15/327.2
2005/0279059 A1 12/2005 Lee et al.
2006/0260282 A1 11/2006 Peng
2010/0115896 A1 5/2010 Reid

* cited by examiner

*Primary Examiner* — Duane Smith
*Assistant Examiner* — Sonji Turner

(57) ABSTRACT

A portable air filter having a cylindrical, perforated shell with an end wall at one end closing the shell and an end wall at the other end having an opening. A hepa filter is removably mounted within the shell adjacent the perforations. The air filter has a blower unit with a through duct and a fan and a motor in the duct. The blower unit is detachably mountable on the shell adjacent the end wall at the other end with one open end of the duct extending through the opening in the end wall. Air is drawn through the perforated shell and hepa filter into the duct and out of the duct through its other open end away from the air filter.

19 Claims, 3 Drawing Sheets

PORTABLE AIR FILTER

BACKGROUND OF THE INVENTION

1. Technical Field

This invention is directed toward a portable air filter. The invention is further directed toward a portable filter unit including the air filter. The invention is also directed toward a carriage for the air filter.

2. Background Art

Portable, on-ground, air filters that take in air to be filtered through a wall of a cylindrical filter, and eject the filtered air from an open end of the cylindrical filter, or an outlet portion in the cylindrical wall of the filter, are well known. Such filters are not however well adapted for filtering air in active workplaces where there is a lot of dust and debris in the air, particularly where the dust and debris in the air is localized in the workplace. The known filters are not readily or easily portable so they can be easily located where the worst air conditions are located in the workplace and/or easily repositioned when the location of the worst air conditions change. The known filters are also not equipped with means to easily distribute the filtered air where needed. They are further not equipped to easily collect the air from specific areas in need of filtering.

SUMMARY OF THE INVENTION

It is the purpose of the present invention to provide a portable air filter that can be easily moved and repositioned when needed. It is another purpose of the present invention to provide an air filter that can be adapted to move air through the air filter in either direction. It is another purpose of the present invention to provide an air filter unit, including the air filter, that can easily distribute the filtered air where needed or collect the air to be filtered from a specific work area. It is a further purpose of the present invention to provide an air filter unit that can be used without a filter to move air some distance to or from the filter unit as required. It is a further purpose of the present invention to provide an air filter unit that includes a carriage for the air filter that is adjustable to be able to mount the air filter in various positions depending on its location and use. It is another purpose of the present invention to provide an air filter unit that has an efficient collector hood for collecting air from a work area. It is still another purpose of the present invention to provide a carriage for an air filter.

In accordance with the present invention, the air filter of the present invention has a rigid, perforated, shell having an open end and a closed end with a blower unit connected to the open end. The blower unit is preferably detachably connected to the shell. The shell is preferably cylindrical in shape. The blower unit has a through duct with an inlet end and an outlet end. There is an impellor in the duct and a motor to rotate the impellor. A Hepa filter is mounted inside, and adjacent, the shell. In normal use, the fan pulls air through the perforated shell and the Hepa filter into the interior space of the Hepa filter to clean the air and then directs it from the interior space into the inlet of the duct and out the duct outlet.

The air filter forms part of an air filter unit. The filter unit can include elongate, flexible, tubing which can be detachably connected to the duct outlet in the blower unit. Connecting means are provided on the blower unit and on the ends of the tubing for connecting the tubing to the blower unit. The tubing can be a single length of tube or several tubes serially connected together. A second blower unit can be provided for connection to the free end of the tubing or for connection between adjacent tubes if needed to efficiently move the air.

The air filter unit, with the tubing, is primarily used to filter the air in a work area, normally passing the air through the shell, and its filter, into its interior, out the blower unit, and through the tubing back to the work area. The filter unit can also be used in reverse to collect and pass air from a work area through the tubing, the blower unit on the air filter, the filter, and the shell. The filter could be omitted when passing air in either direction and then the filter unit is used to just move air efficiently in either direction without filtering it. When collecting air from a localized work area using the tubing, the unit could be provided with a collecting hood having an enlarged inlet and a smaller outlet connected to one end of the tubing.

The air filter unit includes a carriage for carrying the air filter. The carriage has a frame with a bottom support and a top support for receiving the air filter. The carriage has wheels on the bottom support and a handle on the top support by means of which the carriage, with the air filter thereon, can be moved. The carriage has a leg means and short intermediate support means. The leg means can be used to support the frame, and carried air filter, by the wheels and the leg means at an angle to the ground. The frame can also be supported on its bottom support with the frame, and air filter, upright. And the frame, with the air filter, can be horizontal on the ground supported at its front end by the short intermediate support and the wheels.

The invention is particularly directed toward an air filter, the air filter having a shell, the shell comprising a perforated, tubular wall, a first end wall at one end of the tubular wall closing the one end, and a second end wall at the other end of the tubular wall having an opening. A tubular Hepa filter is removably mounted within the shell adjacent the perforated wall. The air filter has a blower unit having a through duct, the duct having duct openings at its two ends, a fan in the duct, and a motor for rotating the fan. The blower unit is mounted, preferably detachably, on the second end wall with the duct passing through the opening in the second end wall to have the one duct opening inside the filter whereby rotation of the fan moves air from outside the air filter through the air filter between the perforated wall and the duct, the air passing through the filter.

The invention is further directed toward an air filter unit employing the air filter and flexible tubing connectable to the other duct opening to direct air to or from the air filter to a desired location.

The invention is also directed toward a carriage for supporting the air filter on the carriage, the carriage having means allowing the carriage, and the carried air filter, to be positioned in one of several different positions as may be needed in the work area and for transporting the air filter to and from the work area and also about the work area as may be needed when using the air filter. The carriage preferably forms part of the filter unit.

DETAILED DESCRIPTION OF THE INVENTION

Figure 1:
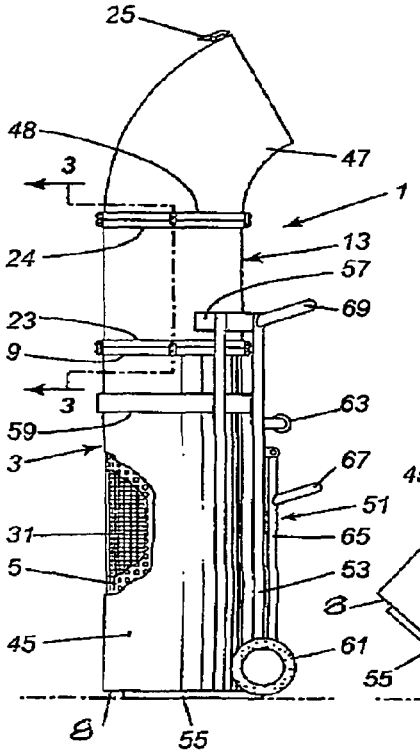
FIG. 1 is a side view, partially cut-away, of the filter unit. Comprising the air filter and the carriage, in an upright position on the ground.

The filter unit 1 of the present invention, as shown in FIGS. 1-4, has an air filter 3 with a rigid, shell 5. The shell 5 is preferably cylindrical in shape, as shown, although other shapes could be used. The shell 5 has a tubular wall 6 defining with perforations 7. One end of the wall 6 is closed with an end wall 8. The other end of the shell 6 has an end wall 9 with a central opening 11 therein.

The air filter 3 includes a blower unit 13 that is mounted to the shell 5 adjacent its end wall 9. The blower unit 13 has a through duct 15 with duct openings 17, 19 at the ends of the duct. Duct opening 17 is normally the inlet to the duct 15 and duct opening 19 is normally the outlet from the duct 15. A fan 20, and an electric motor 21 for rotating the fan 21, are mounted in the duct 15. The duct 15 can have a collar 22 with end walls 23, 24 near the duct openings 17, 19. The blower unit 13 is preferably detachably mounted on the other, open end of the shell 5 with the duct 15 passing through the opening 11 in the end wall 9 of the shell 5 to locate the inlet duct opening 17 within the shell 5. The end wall 23 of the collar 22 on the duct 15 sits on the end wall 9 of the shell 5 to locate the blower unit 13 on the shell 5. Cooperating connectors on the blower unit 13 and shell 5 detachably connect the blower unit 13 to the shell 5. The connectors can comprise a first, male, connector member 25 on the collar 22 of the blower unit 13 adjacent the end wall 23 and a second, female, connector member 25A on the shell 5 adjacent the end wall 9. The connector members 25, 25*a* could be cooperating clasp members but any well known two-part connectors could be used to detachably connect the blower unit 13 to the shell 5. Suitable seals (not shown) are employed between the duct 15 on the blower unit 13 and the end wall 9 of the shell 5 to provide an air-tight connection.

Figure 4:
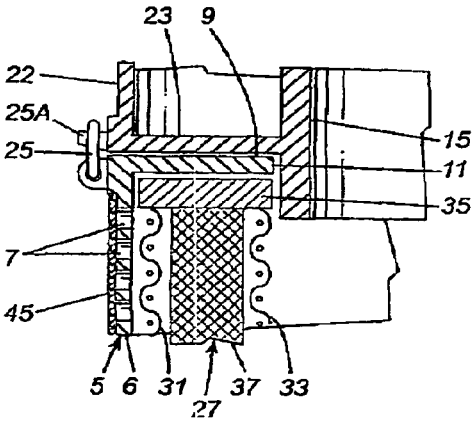
FIG. 4 is an enlarged view of detail 'A' in FIG. 3.

The air filter 3 employs a Hepa filter 27 having a tubular shape with a relatively thick wall as shown in FIG. 4. The Hepa filter 27 is preferably cylindrical and the wall of the filter is formed by outer and inner cylindrical wire mesh walls 31, 33 held together, one within the other, by annular end walls 35. The space between the walls 31, 33 is filled with Hepa filtering material 37. The Hepa filter 27 is mounted within the perforated shell 5 with the outer wall 31 of the filter adjacent the inner surface of the shell wall 6. The Hepa filter 27 is retained adjacent the shell wall 6 by the end walls 8, 9. One of the end walls 8, 9 is made removable to allow insertion/removal of the filter 27 within the shell 5. The duct opening 17 on the duct 15 in the blower unit 13 is positioned within central space 39 within the Hepa filter 27.

If desired, a sheath 45 of flexible filtering material can envelope the shell 5 to pre-filter the air passing through the shell 5 and the Hepa filter 27. The sheath 45 is removable to clean it for reuse. The sheath can be made of suitable fabric material. The ends of the sheath can be elastic.

A relatively short outlet duct 47 of generally rigid, yet bendable, material can be mounted to the duct 15 at the duct opening 19 at the outer end of the blower unit 13. The inner end 48 of the outlet duct 47 has a rigid collar 49 sized to fit over the duct 15 and abut the end wall 24 of the collar 22 on the duct 15. The outer diameter of the inner end 48 of the duct 47 is preferably the same as the outer diameter of the collar 22 on the blower unit 13. Clasp members 25 on the collar 22 will clamp on clasp members 25A on the duct 47 to detachably connect the duct 47 in place on the blower unit 13. The outlet duct 47 can be initially manipulated to direct the air from the blower unit 13 in the desired direction. A pressure gage (not shown) can be provided on the blower unit to measure the drop in pressure signifying that the pre-filter sheath is getting clogged and needs replaced and/or cleaning.

Figure 2:
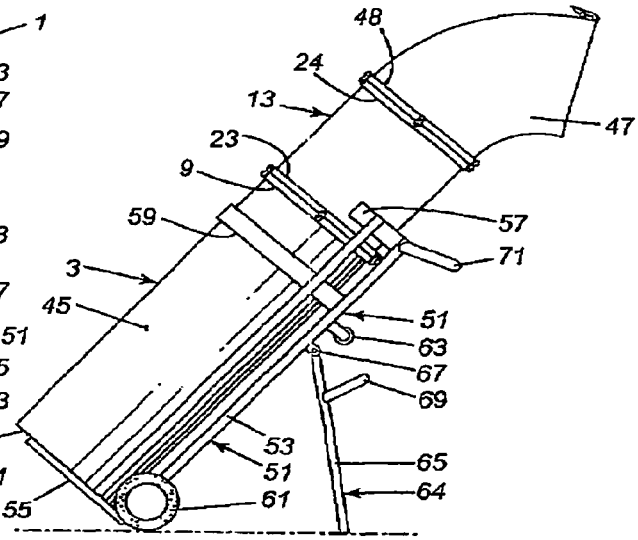
FIG. 2 is a side view of the filter unit at an angled position on the ground.

The filter unit 1 includes a carriage 51 to hold the air filter 3. The carriage 51, as shown in FIGS. 1 and 2, has an elongate frame 53 with a bottom support 55 on the bottom, front of the frame, receiving the bottom end wall 8 of the shell 5 of the air filter 3. There is also an upper support 57 on the upper, front of the frame 53 spaced from the bottom support 55. The supports 55, 57 are shaped to partly cradle the air filter 3 to support it on the carriage. Straps 59 extending from the frame 53 of the carriage 51, adjacent the upper support 57, can be used to hold air filter 3 on the supports 55, 57.

The carriage 51 has a pair of wheels 61 mounted on the frame 53 adjacent the bottom support 55. The wheels 61 could instead be mounted on the bottom support 55 adjacent the frame 53. In either case, the wheels are positioned just behind and just above the bottom support 55 so that the wheels 61 do not touch the ground when the carriage 51 is upright but do touch the ground when the carriage 51 is tilted forwardly. A single swivel wheel 63 can be mounted on the frame 53 near the upper support 57. The swivel wheel 63 can be pivoted from an inoperative position, close to the frame 53, to an operative position where it is spaced farther from the frame 53.

The carriage 51 carries leg means 64 in the form of a pair of support legs 65, one on each side of the frame 53, the legs pivoted by pivots 67 at their upper end to the frame 53 near the upper support 57. The legs 65 are joined, near the pivots 67, by a short u-shaped brace 69 that, when the legs 65 are detachably held inoperative against the frame 53, is angled downwardly and slightly forwardly. The brace 69 normally extends past the inoperative swivel wheel 63 when the wheel 63 is in its inoperative position adjacent the frame 53. The wheel 63 extends past the brace 69 when pivoted to an operative position. A handle 71 extends from the upper end of the frame 53. While the leg means have been described as a pair of legs, one on each side of the frame, other leg arrangements can be used.

Figure 3:
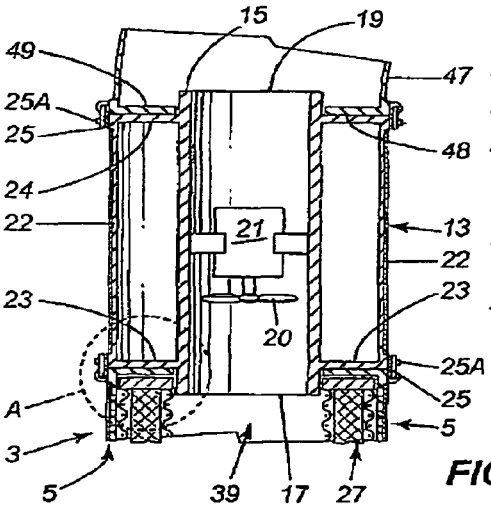
FIG. 3 is a partial cross-sectional view of the upper part of the air filter taken along line 3-3 in FIG. 1.

The filter unit 1 can be wheeled where needed by one person using the wheels 61 and the handle 71 of the carriage 51. The carriage 51 can position the held air filter 3 in an upright position with the blower unit 13 on top, as shown in FIG. 1, when the carriage is standing on its flat, bottom support 55 on the ground. The carriage 51 can also position the air-filter 3 in a generally horizontal position if needed, close to the ground, when resting on its rear wheels 61 and the u-shaped brace 67 carried by the legs 65 on the frame 53. If it is desired to reposition the air filter while in the horizontal position, the swivel wheel 63 can be employed to extend just past the brace 67 and the carriage can be rolled where needed on the wheels 61, 63 while in the horizontal position. The carriage 51 can also position the air filter 3 at an angle to the ground, if needed, as shown in FIG. 3. The legs 65 on the frame 53 are swung out away from the frame to be nearly transverse to the frame. Suitable stop means (not shown) limit the outward swing of the legs. With the legs 65 swung out, the carriage rests on the legs 65 and the wheels 61 at a preferred angle of about forty five degrees. The angle can range between about thirty five and fifty five degrees. The angled position of the air filter 3 makes it easier to position the outlet duct 47 in the direction you wish the air to flow from the unit.

The filter unit 1 can be used to clean the air in a room using the Hepa filter 27, and, if desired or needed, the pre-filter 45. A room might, for example, be undergoing renovations and there could be a lot of dust in the air in the room. In use, the filter unit 1 is wheeled into the room and set up in the best position to be out of the way of the workers while being able to filter the air. The fan 20 in the air filter 3 is then operated to draw room air into the unit through the perforations 7 in the wall 6 of the shell 5 and through the Hepa filter 27 into the center of the shell, out through the open end 9 of the shell through the blower unit 13, and back into the room from the outlet duct 47. The air, in passing through the filter unit, passes through the pre-filter sheath 45 outside the shell 5, if the sheath is used, and then through the Hepa filter 27, to remove the dust particles. Air is drawn in from all around the shell. The filter unit 1 can be utilized when it is on the ground resting on the back wheels 61 and the brace 67; when it is upright standing on the bottom support 55 on the frame 53, or when it is resting on the legs 65 and wheels 61 at an angle to the ground.

Figure 5:
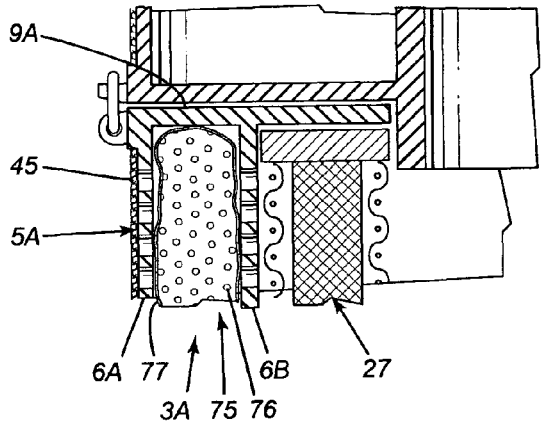
FIG. 5 is a partial cross section view, similar to FIG. 4 of another embodiment of the invention.

In a preferred embodiment, as shown in FIG. 5, the air filter 3A employs a rigid, cylindrical, tubular shell 5A having inner and outer perforated walls 6A, 6B. The inner and outer walls 6A, 6B are joined at one end by the open end wall 9A of the shell and at their other ends by the closed end wall (not shown). The inner and outer walls 6A, 6B are spaced apart to form an annular storage space 75. The open end wall 9A is removable to provide access to the space 75. Filter medium 76, in the form of granular material, either loose, or loosely encased in a porous sack 77 can be inserted into the space 75 to fill it up. The Hepa filter 27 is mounted next to the surface of the inner wall 6B. The granular filter medium 76 can be designed to remove one or more specific, unwanted, contaminate elements from the air. An outer filter sheath 45 can still be used with this embodiment to pre-filter the air.

Figure 7:
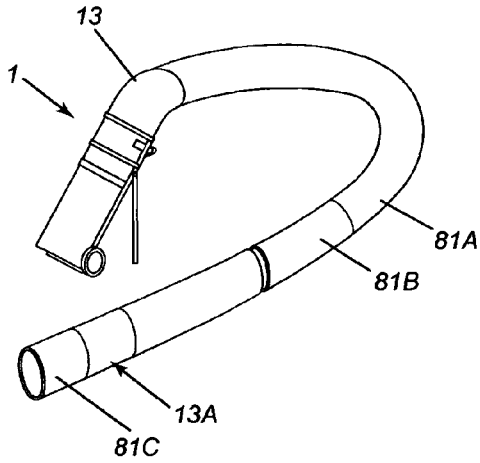
FIG. 7 is a schematic view showing part of the filter unit with a second blower unit.

The unit 1 can employ elongate, flexible, tubing 80 to transport the filtered air to a desired location as shown in FIG. 7. The tubing 80 is lightweight and can be of the type supported by an internal coil of wire. The tubing 80 can be a single length of tube 81 where one end of the tube 81 is provided with male clasp member 25 and the other end of the tube is provided with female clasp member 25A. The tube 81 can be attached on the outlet end of the generally rigid, short, outlet duct 47 by locating the tube end with female clasp member 25A adjacent the outlet end of duct 47 which would carry male clasp member 25. Alternatively, and preferably, the tube 81 can connect directly to the opening 19 of the duct 15 on the blower unit 13 with clasps 25, 25A, the tube 81 replacing the duct 47. The tube 81 would be located with its end carrying female clasp member 25A adjacent the blower unit 13 carrying male clasp 25 at its end.

Figure 6:
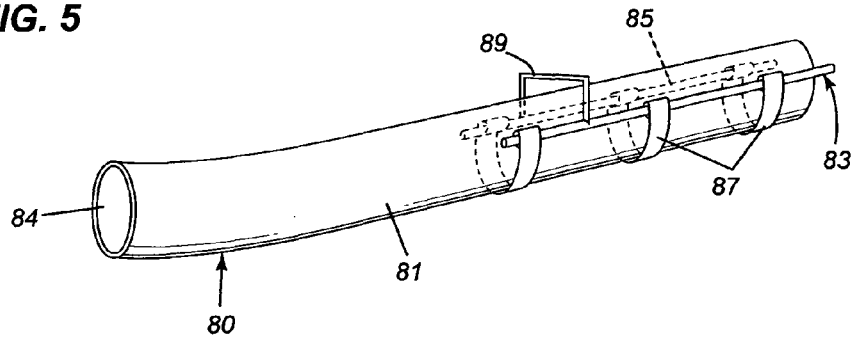
FIG. 6 is a schematic view showing part of the filter unit with a flexible duct and a wand.

A support wand 83, as shown in FIG. 6, can be attached to a portion of the tubing 80 near its unattached, open end 84 so that the operator can manipulate the open end 84 of the tube 81 with the wand 83 to a desired position. The wand can have an open, rigid, cradle-type frame 85 for the tube 81 with spaced apart straps 87 forming slings to hold the tube 81 in the frame 85. The frame 85 has a handle 89 for manipulating the wand and thus the attached tube.

While the tubing 80 has been shown as a single tube 81, it can comprise two or more tubes 81A, 81B, 81C serially connected together. If needed, a second blower unit 13A can be inserted between adjacent tubes 81A, 81B or 81B, 81C as shown in FIG. 7, to boost the air flow through the tubing. Again, detachable connectors such as clasps 25, 25A connect the tubing, or the tubes 81A, 81B, etc. and the second blower unit 13A, if needed, together. Each tube 81, 81A, etc has a male connector at one end and a female connector at the other end.

Figure 8:
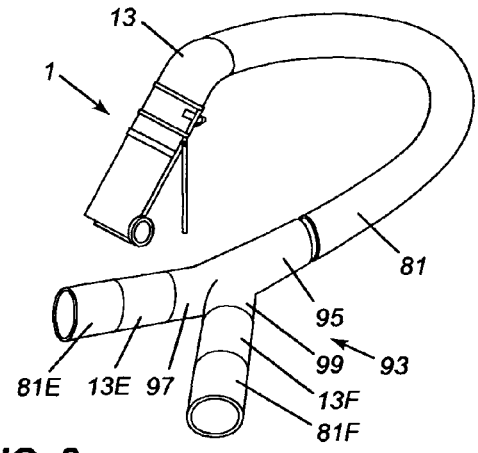
FIG. 8 is a schematic view showing part of the filter unit with branch lines.

Branch units could also be employed to distribute air from the filter unit 1. For example a y-fitting 93 could be attached, via its stem 95 to the end of the tube 81 as shown in FIG. 8 and a blower unit 13E, 13F could be attached in each branch 97, 99 of the y-fitting 93. A tube 81E, 81F could lead from each blower unit 13E, 13F to a different location in the room.

The filter unit 1 is normally used for filtering and normally has the fan 21 draw air through the duct 15 from duct opening 17 to 19. The blower unit 13 is mounted to have the duct opening 17 within the shell 5 to draw air out of the shell 5 into the blower unit and out of the filter unit. The filter unit can also be used without a filter to move air out of the room, using tubing 80 connected to the duct opening 19 of the blower unit 13, if it is desired to ventilate the room or to under pressure the room for any reason. If desired or required however, the blower unit 13 can be reversed, locating duct opening 17 outside of shell 5, and duct opening 19 within the shell 5 to draw air into the shell from the blower unit. In this configuration, the filter unit can be used with a filter to filter the air and return it to the room from the shell. The filter unit can also be used without a filter, and with tubing 80 now connected to duct opening 17 of the blower unit, to draw air into the room from outside the room to overpressure the room, if required for any reason.

Figure 9:
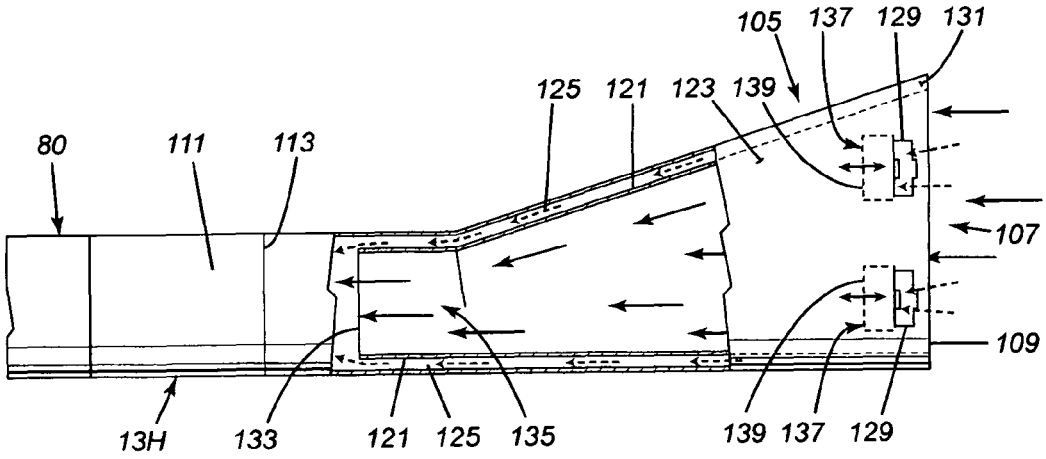
FIG. 9 is a side view, in partial cross-section showing part of the filter unit with a collector hood.

The filter unit 1 can have a collector hood 105 for use with the tubing 80 and the air filter 3. The collector hood 105 would be used to collect the air to be cleaned to direct it to the air filter 3 via the flexible tubing 80 connected to the blower unit 13. The hood 105, as shown in FIG. 9, would have a large air inlet 107, about one to two square feet in area, on one side 109 of the hood and a small air outlet 111, less than one square foot in area, on the opposite side 113, of the hood. The hood 105 tapers down from the inlet 107 to the outlet 111. The outlet 111 is cylindrical and a standard size to receive one end of the flexible tubing 80 used. The other end of the tubing 80 would be connected to the blower unit 13 on the air filter 3. If needed, a booster blower unit 13H could be inserted between the tubing 80 and the hood 105 as shown. The blower unit 13H would have been set up to draw air into the tubing 80 from the collector hood 105 either by reversing the motor to change the direction of rotation of the fan or by changing the position of the blower unit relative to the hood. The collector hood 105 and the flexible tubing 80 would have co-operating connectors such as clasp members 25, 25A for detachably connecting the tubing to the collector hood or for detachably connecting both the tubing 80 and the hood 105 to the booster blower unit 13H.

When drawing the air into the collector hood 105, since the hood tapers down from the inlet 107 to the outlet 111, there is usually turbulence at the inlet 107 of the hood and a cloud of dust often surrounds the inlet of the hood. To minimize the dust cloud, and make air collection more efficient, the hood 105 can be modified by providing it with a double wall, 121, 123 which walls define a collecting channel 125 between them. Rim inlet openings 129 are provided in the outer wall 123, and in the inner wall 121 as well, if needed, adjacent the rim 131 of inlet 107 to collect the dust cloud surrounding the inlet rim of the hood. The inner wall 121 ends short of the outer wall 123 at the outlet end of the hood providing an outlet 133 from the interior of the inner wall 121. As the blower unit on the air filter, or the blower unit 13H adjacent the hood 105, draws air into the hood through the inlet 107, as shown by the solid arrows, it also draws in the dust cloud that forms about the inlet 107 due to turbulence. The dust cloud air is drawn in through the rim inlet openings 129 as shown by the broken arrows and travels to the outlet 111 through the channel 125. As the dust cloud air leaves the channel 125 just short of the outlet 111, and passing the outlet 133 of the inner wall 121, it combines with the air drawn in through the inlet 107 and the passage 135 formed by inner wall 121, and the mixed air stream flows out of the hood, through the blower 13H if used, and through the tubing 80 to the air filter (not shown). If desired, adjustable closure means 137 can be associated with each rim inlet opening 129 to adjust its size as needed. The closure means 137 can comprise slidable plates 139 that can mounted on the outer wall 123, in suitable guide means (not shown), to slide over the rim inlet openings 129 to limit their size of as needed. Other closure means can be employed. While the hood has been provided with inlet openings 129 to collect the dust cloud about the hood inlet, other means can be employed to collect the dust cloud.

Figure 10:
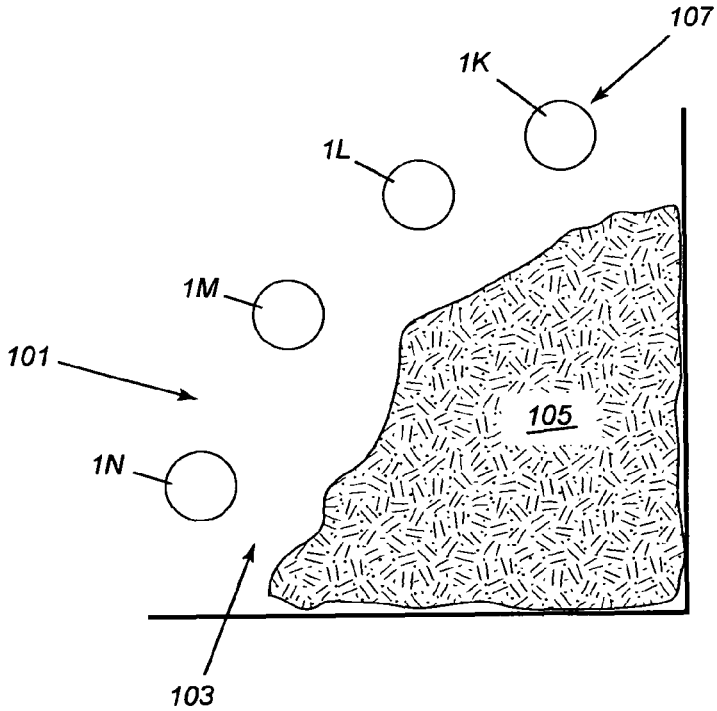
FIG. 10 is a schematic view showing a number of units arrange in an air capture cleaning configuration.

A plurality of filter units 1K, 1L, 1M, etc. can be used in a large room area 141 to seal off a portion 143 of the room area to capture and clean the air 145 in the sealed-off portion as shown in FIG. 10. The units would be employed in an upright position and spaced apart and arranged like a fence 147 to separate the portion 143 to be cleaned from the remainder of the room area 141.

We claim:

1. An air filter, the air filter having a shell, the shell comprising a perforated, tubular wall, a first end wall at one end of the tubular wall closing the one end, a second end wall at the other end of the tubular wall having an opening; a tubular Hepa filter removably mounted within the shell adjacent the perforated wall; a blower unit outside the shell having first and second ends, a through duct passing through the unit past the first and second ends of the unit, the duct having an inlet opening at one end and an outlet opening at its other end, a fan in the duct, and a motor for rotating the fan; connecting means for mounting the first end of the blower unit on the second end wall of the shell with the duct passing through the opening in the second end wall to have the inlet opening inside the filter whereby rotation of the fan moves air from outside the air filter through the air filter between the perforated wall and the duct, the air passing through the filter to the duct.

2. An air filter as claimed in claim 1 wherein the connecting means including first, first connecting means on the first end of the blower unit near the inlet duct opening and second connecting means on the other end of the tubular wall; the first, first connecting means and second connecting means cooperating to detachably mount the first end of the blower unit on the second end wall with the outlet duct opening inside the filter.

3. An air filter as claimed in claim 1 wherein the fan can be rotated by the motor in one direction to draw the air through the perforated wall, the filter, and the duct, the air leaving the air filter through the outlet duct opening.

4. An air filter as claimed in claim 3 wherein the rotation of the fan can be reversed by reversing the rotation of the motor to draw air through the outlet duct openings, through the duct into the filter, through the filter, and then through the perforated wall.

5. An air filter as claimed in claim 1 wherein the blower unit is detachable from the second end wall, invertable, and mountable with its second end on the second end wall in the inverted position to have the outlet duct openings inside the filter, the rotation of the fan in the same one direction drawing air though the inlet duct openings, through the duct into the filter and through the filter, and out of the air filter through the perforated wall.

6. An air filter as claimed in claim 5 wherein the connecting means has second, first connecting means on the second end of the blower unit near the outlet duct opening; the second, first connecting means on the blower unit and the second connecting means on the other end of the tubular wall detachably connecting the second end of the blower unit and the other end of the tubular wall together.

7. An air filter as claimed in claim 1 where the shell has a double wall, both walls perforated and spaced-apart to form a storage space for a second filter medium designed to remove one or more specific contaminates from the air, the Hepa filter mounted against the inner surface of the inner wall.

8. An air filter as claimed in claim 1 wherein the perforated wall is enclosed with a removable fabric filter.

9. A filter unit having: an air filter, the air filter having a shell, the shell comprising a perforated, tubular wall, a first end wall at one end of the tubular wall closing the one end, a second end wall at the other end of the tubular wall having an opening; a tubular Hepa filter removably mounted within the shell adjacent the perforated wall; a blower unit outside the shell having first and second ends, a through duct passing through the unit past the first and second ends of the unit, the duct having an inlet opening at one end and an outlet opening at its other end, a fan in the duct, and a motor for rotating the fan; connecting means for mounting the first end of the blower unit on the second end wall of the shell with the duct passing through the opening in the second end wall to have the inlet duct opening inside the filter whereby rotation of the fan moves air from outside the air filter through the air filter between the perforated wall and the duct, the air passing through the filter to the duct; and flexible, elongated tubing, the tubing detachably mounted by one end to the blower unit to connect to the outlet opening to move air from the blower unit.

10. A filter unit as claimed 9 wherein the connecting means include first, first connecting means on the first end of the blower unit near the inlet duct opening and second, first connecting means on the blower unit near the outlet duct opening; second connecting means on the other end of the tubular wall; the first, first connecting means and second connecting means detachably mounting the blower unit on the other end of the tubular wall; first and second connecting means on the ends of the tubing, the second, first connecting means on the blower unit and the second connecting means on the tubing detachably connecting the tubing to the blower unit.

11. A filter unit as claimed in claim 9 wherein operation of the motor will rotate the fan in one direction to draw the air through the perforated wall, the filter, and the duct, the air leaving the air filter through the outlet duct openings and the tubing.

12. A filter unit as claimed in claim 9 wherein rotation of the motor can be reversed reversing the rotation of the fan from the first direction, to draw air into the air duct through the tubing and the outlet duct opening, through the duct, the filter, and the perforated wall.

13. A filter unit as claimed in claim 9 wherein the blower unit is detachable from the second end wall, invertable, and mountable with its second end on the second end wall in the inverted position to have the outlet duct opening inside the filter, the rotation of the fan in the same one direction drawing air through the tubing, through the inlet duct opening, through the duct into the filter and through the filter, and out of the air filter through the perforated wall.

14. A filter unit as claimed in claim 9 including a second blower unit, identical to the first blower unit, the second blower unit detachably connected to the other end of the tubing.

15. A filter unit as claimed in claim 9 including a collector hood for detachable connection to the other end of the tubing to. collect air for the air filter.

16. A filter unit as claimed in claim 15 wherein the hood has an enclosing wall with an inlet in the wall on one side and an outlet in the wall opposite the inlet, the inlet enlarged compared to the outlet, the outlet connectable to the other end of the tubing; the wall being a double wall with an air space between the walls, the air space leading to the hood outlet, and at least one secondary air inlet in the outer wall of the double wall at the inlet end of the hood connected to the air space, the secondary air inlet collecting air that turbulently collects about the inlet of the hood during collection of the air by the hood.

17. A filter unit as claimed in claim 16 including movable closure means on the hood for varying the size of the secondary air inlet.

18. A filter unit as claimed in claim 9 where the shell has a double wall, both walls perforated and spaced-apart to form a storage space for a second filter medium designed to remove one or more specific contaminates from the air, the Hepa filter mounted against the inner surface of the inner wall.

19. An air filter unit as claimed in claim 9 wherein the unit includes a wand for supporting the flexible tubing near its other end, the wand having a rigid frame for cradling the tubing, and a handle on the frame for allowing the operator to move the other end of the tubing to a desired position.

* * * * *